US007154521B2

(12) United States Patent
Shimoda

(10) Patent No.: US 7,154,521 B2
(45) Date of Patent: Dec. 26, 2006

(54) THERMAL PRINTER AND PORTABLE-TYPE TERMINAL EQUIPMENT

(75) Inventor: Yuji Shimoda, Inagi (JP)

(73) Assignees: Fujitsu Limited, Kawasaki (JP); Fujitsu Frontech Limited, Tokyo (JP)

( * ) Notice: Subject to any disclaimer, the term of this patent is extended or adjusted under 35 U.S.C. 154(b) by 0 days.

(21) Appl. No.: 10/671,787

(22) Filed: Sep. 29, 2003

(65) Prior Publication Data

US 2004/0061769 A1 Apr. 1, 2004

(30) Foreign Application Priority Data

Sep. 30, 2002 (JP) ..... 2002-284765

(51) Int. Cl.
*B41J 2/325* (2006.01)

(52) U.S. Cl. ..... 347/222

(58) Field of Classification Search ..... 347/222, 347/218, 223; 400/88, 136, 175, 621, 649, 400/690.2, 690.3, 690.4, 691, 693; 346/24
See application file for complete search history.

(56) References Cited

U.S. PATENT DOCUMENTS 4,663,638 A 5/1987 Hirose
4,757,329 A * 7/1988 Sato et al. ..... 347/218
5,579,043 A 11/1996 Patry
6,004,053 A * 12/1999 Petteruti et al. ..... 400/693
6,118,469 A 9/2000 Hosomi
6,261,013 B1 * 7/2001 Bryer et al. ..... 400/613
6,364,550 B1 4/2002 Petteruti
6,406,200 B1 * 6/2002 Mahoney ..... 400/120.16
6,443,645 B1 9/2002 Takei et al.
6,450,714 B1 * 9/2002 Mori et al. ..... 400/649
6,652,170 B1 * 11/2003 Arnold ..... 400/88
6,682,239 B1 * 1/2004 Mori et al. ..... 400/649

FOREIGN PATENT DOCUMENTS

EP 1 038 687 A2 3/2000
JP 3096702 8/2000

* cited by examiner

*Primary Examiner*—K. Feggins
(74) *Attorney, Agent, or Firm*—Armstrong, Kratz, Quintos, Hanson & Brooks, LLP

(57) ABSTRACT

A thermal printer detachably connected to a portable type terminal equipment. The printer has a printer cover including upper and lower covers hinged together. A printer head is arranged in the body of the portable type terminal equipment, and a platen is arranged in the upper cover. The platen is usually held in the upper cover but can be released from it when undesirable force is applied to it. Therefore, a straight line connecting the platen shaft to the hinge shaft is generally parallel to the bottom surface of the portable type terminal equipment and the printer head is generally perpendicular to the straight line, so that a pressure applied by the printer head to the platen is reduced.

2 Claims, 4 Drawing Sheets

THERMAL PRINTER AND PORTABLE-TYPE TERMINAL EQUIPMENT

BACKGROUND OF THE INVENTION

1. Field of the Invention

The present invention relates to a thermal printer free from the falling-off of a platen even if a printer cover is irregularly operated, and a portable type terminal equipment to which the thermal printer is connected.

2. Description of the Related Art

In the conventional thermal printer, when a printing medium such as a paper sheet is set in the thermal printer, a printer cover is initially opened, and the end of the printing medium, wound usually in the form of a roll, is then inserted into a gap between a printer head and a platen which is in contact with the printer head and rotates to feed the printing medium during the printing operation. Thereafter, the printing medium is pushed into an accommodation space therefor and, finally, the printer cover is closed to complete the setting operation. However, as the gap between the printer head and the platen is as small as several millimeters and, therefore, care must be taken when manually passing the printing medium through the gap, a considerable time is required and an excessive load is placed on the user.

To solve this problem, a thermal printer is known in that the platen is not fixedly arranged with respect to the printer head but provided in the printer cover so that the platen is brought into contact with the printer head when the printer cover is closed (for example, Japanese Patent Publication No. 3096702 (page 2, third paragraph and attached drawings)). In this structure, the user pulls an end of the rolled printing medium, several centimeters long, to the outside after opening the printer cover upward and, then, puts the printing medium into the accommodation space therefor, and then the printer cover is closed. Thus, the printing medium is set in the printable state by simple steps. Generally, this type of thermal printer is called as an easy-loading printer.

FIG. 4 of the attached drawings illustrates a side sectional view of the conventional thermal printer coupled to one end of a portable type terminal equipment widely used for meter inspection or inventory management in the distribution field. A printer cover 30 comprises an upper cover 18 and a lower cover 19, and the upper cover 18 is connected to the lower cover 19 by a hinge 22 and is opened and closed about the pivot axis of the hinge in the direction shown by the arrow c. A platen 20 is provided in the upper cover 18 in a semi-fixed state so that when the upper cover 18 is opened upward, the platen 20 also moves upward together with the upper cover 18. This thermal printer is adapted to be detachable from the portable type terminal equipment by the application of a certain force at the end of the printer cover 30 in the direction of the arrow A, by the user, which may preferably accompany the movement in the clockwise direction (as shown in FIG. 4 by the arrow a), when the printer is not necessary. However, if a force is applied in the counterclockwise direction b to the printer cover 30 by mistake, or from outside by accident, the printer cover 30 can be detached from the portable type terminal equipment, but as apparent from FIG. 4, the printer head 24 is inclined slightly rightward and brought into contact with the platen 20 and there is a problem in that the platen 20 remains while being in contact with the printer head 24 due to the pressure of the printer head 24 if the force is applied to the printer cover 30 in the counterclockwise direction b. This may cause a failure of the platen 20 or other peripheral parts.

SUMMARY OF THE INVENTION

To solve the above-mentioned problems, the present invention provides a thermal printer connectable to a portable type terminal equipment. The thermal printer comprises a printer head for carrying out printing operation onto a printing medium, a printer cover having members coupled together by a hinge to be openable and closable about the hinge, and a platen provided in the printer cover in contact with the printer head when the printer cover is closed, wherein a straight line connecting a shaft of the platen to a shaft of the hinge is generally parallel to a bottom surface of the portable type terminal equipment and the printer head is generally perpendicular to the straight line connecting the platen shaft to the hinge shaft when the thermal printer is connected to the portable type terminal equipment.

Also, to solve the above-mentioned problems, the present invention provides a thermal printer comprising a printer head for carrying out a printing operation onto a printing medium, a printer cover having members coupled together by a hinge to be openable and closable, and a platen provided in the printer cover in contact with the printer head when the printer cover is closed, wherein the printer head is disposed at an angle not interfering with an arc defined by the moving platen when the platen is separated from the printer head by opening the printer cover from a state in which the printer head is brought into contact with the printer head.

Further, to solve the above-mentioned problems, the present invention provides a portable type terminal equipment comprising an input section for inputting business data, a display section for displaying the business data; a printer head for carrying out a printing operation onto a printing medium, a printer cover having members coupled together by a hinge to be openable and closable, and a platen provided in the printer cover in contact with the printer head when the printer cover is closed, wherein the printer head is disposed at an angle not interfering with an arc defined by the moving platen when the platen is separated from the printer head by opening the printer cover from a state in which the printer head is brought into contact with the printer head.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

A preferred embodiment of the present invention will be described below with reference to the attached drawings.

Figure 1:
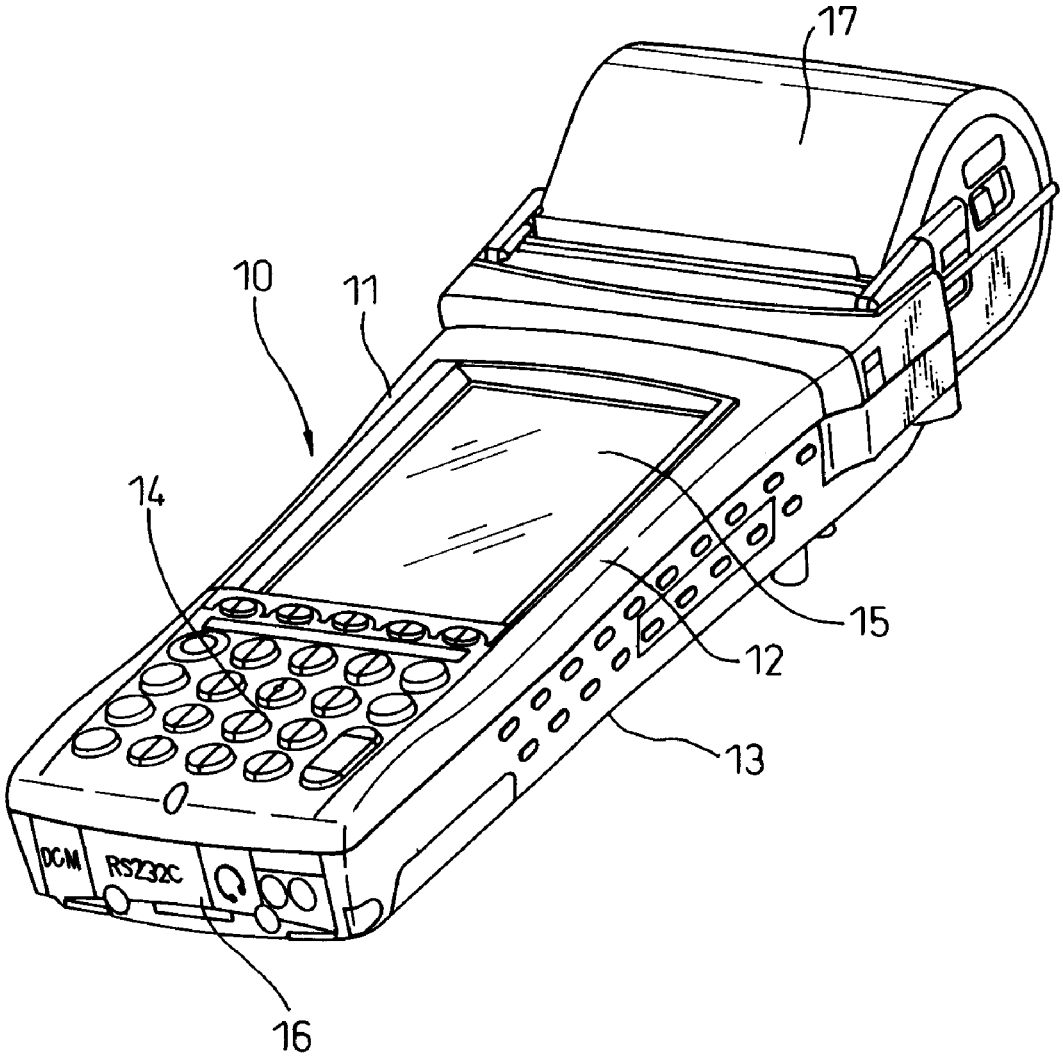
FIG. 1 is a perspective view of a portable type terminal equipment, according to an embodiment of the present invention.

FIG. 1 is a perspective view of a portable type terminal equipment according to the embodiment of the present invention. The illustrated portable type terminal equipment 10 is used by a user, while it carried, for example, when inspecting a gas meter for charging for the gas or managing an inventory in a shop such as a supermarket. The portable type terminal equipment 10 comprises a body 11 with an upper surface 12 and a bottom surface 13. The body 11 has an input section 14 including a plurality of key groups, a display section 15 for displaying various data, and a connector section 16 for connection to external devices such as a PC for communication. A thermal printer 17 for printing various data is coupled to the body 11.

Figure 2:
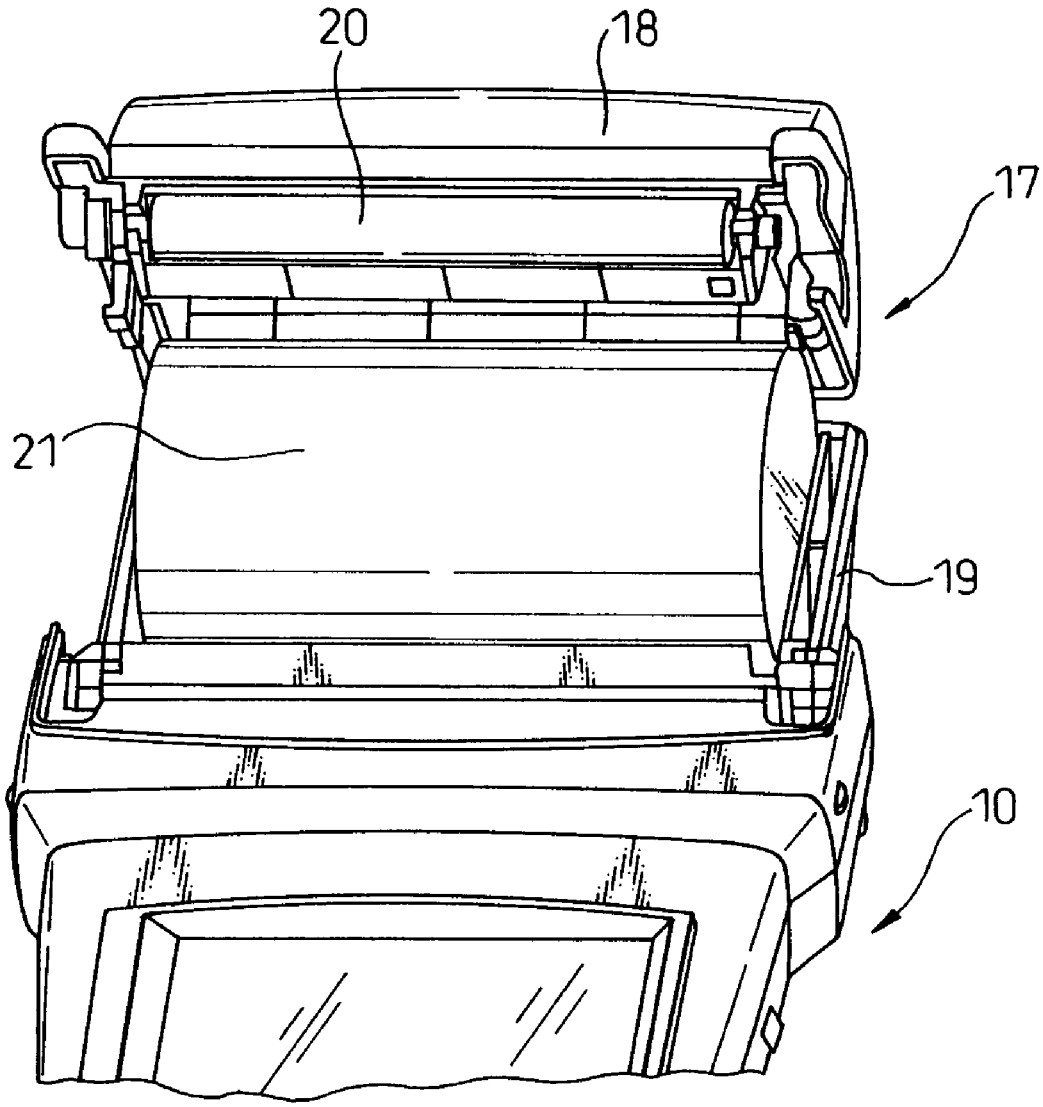
FIG. 2 is a perspective view of the thermal printer in the opened state.
Figure 3:
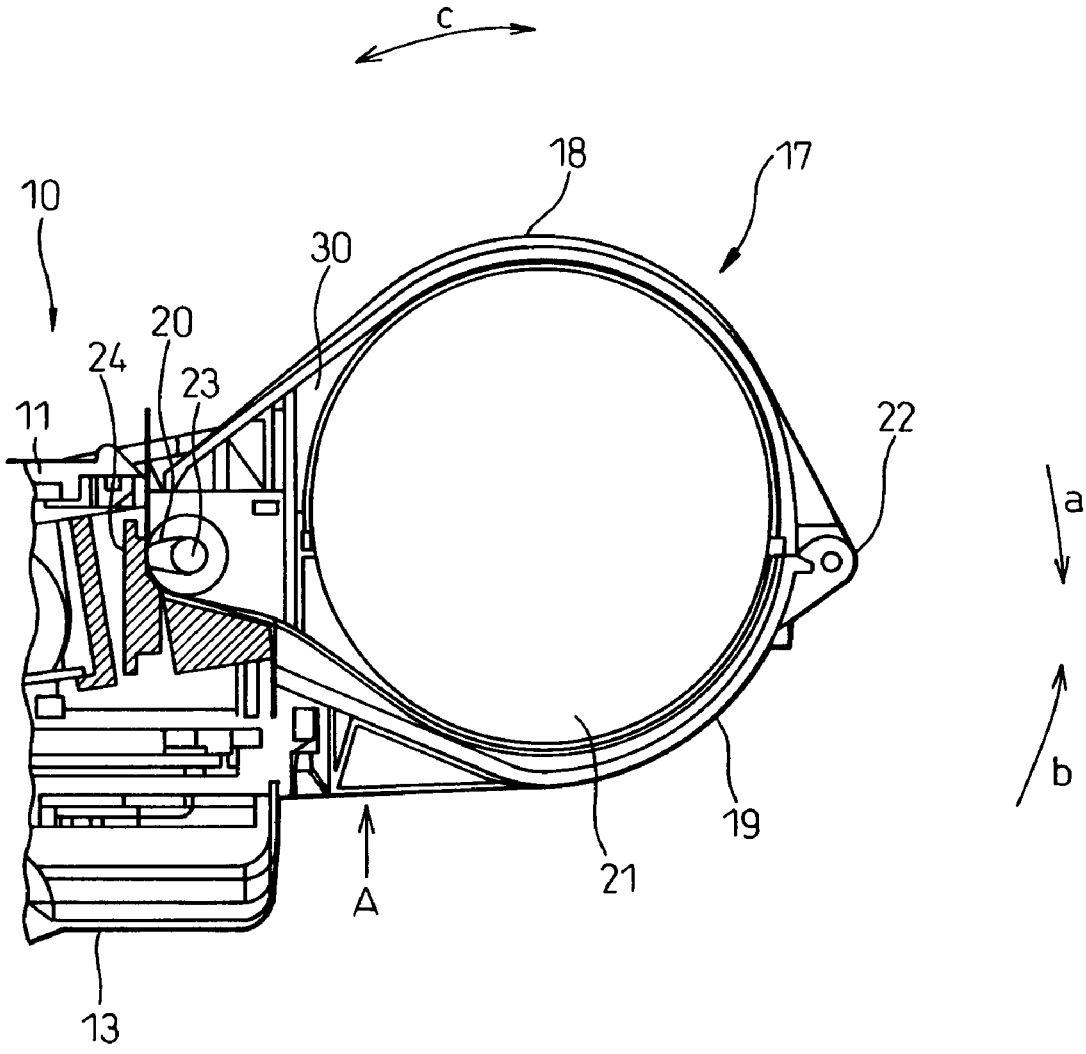
FIG. 3 is a side sectional view of the thermal printer.

FIG. 2 is a perspective view of the thermal printer 17 according to the embodiment of the present invention. The thermal printer 17 has a printer cover 30 comprising an upper cover 18 and a lower cover 19 hinged together by a hinge 22 (FIG. 3). In FIG. 2, the upper cover 18 of the thermal printer is opened, and therefore, it can be seen that a platen 20 is provided in the upper cover 18. The interior space formed by the upper cover 18 and the lower cover 19 is an accommodation space for a printing medium in which a printing medium 21 in the form of a roll is set in this embodiment.

FIG. 3 is a side sectional view of the thermal printer 17 according to the embodiment. The printer cover 30 is detachably coupled to the body 11 and can be detached from the body 11, by applying a pressure to it in the direction of the arrow A. In the embodiment, the printing medium 21 in the form of a roll is placed in the accommodation space formed by the lower cover 19 located at a lower position and the upper cover 18 located at an upper position, as seen from the side of the thermal printer. The upper cover 18 is rotatable in the direction shown by the arrow c about a hinge shaft of the hinge 22 to occupy an opened position or a closed position. The platen 20 is usually made of rubber or a like-material, has a platen shaft 23 and is provided in a semi-fixed manner at the end of the upper cover 18 remote from the hinge 22. The platen shaft 23 is inserted in a horizontally elongated slot provided in a side cover member. The slot has an inlet gap at the left end thereof, from which the platen shaft 23 can be inserted in the slot. When the printing operation is carried out onto the printing medium, the printing medium 21 is pulled out, by members not shown, during which the platen 20 rotates about the platen shaft 23 to deliver the printing medium in the correct direction.

Also, a printer head 24 is mounted on the body 11 so that it is brought into contact with the platen 20. The platen 20, the hinge 22 and the printer head 24 are arranged such that a straight line connecting the platen shaft 23 and the hinge shaft of the hinge 22 is generally parallel to the bottom surface 13 of the body 11 of the portable type terminal equipment 10, and the printer head 24 is arranged generally vertical and generally perpendicular to the straight line connecting the platen shaft 23 and the hinge shaft of the hinge 22. The body 11 has side frame members having upwardly open U-shaped guide slots and the ends of the platen shaft 23 fall in the guide slots and are guided therein. The ends of the platen shaft 23 can leave the guide slots when the platen 20 moves upwards but the platen shaft 23 may frictionally contact the vertical walls of the guide slots if the platen shaft 23 moves upwardly and obliquely. However, the platen shaft 23 can smoothly goes out of the guide slots because the platen 20 moves outwardly vertically.

Figure 4:
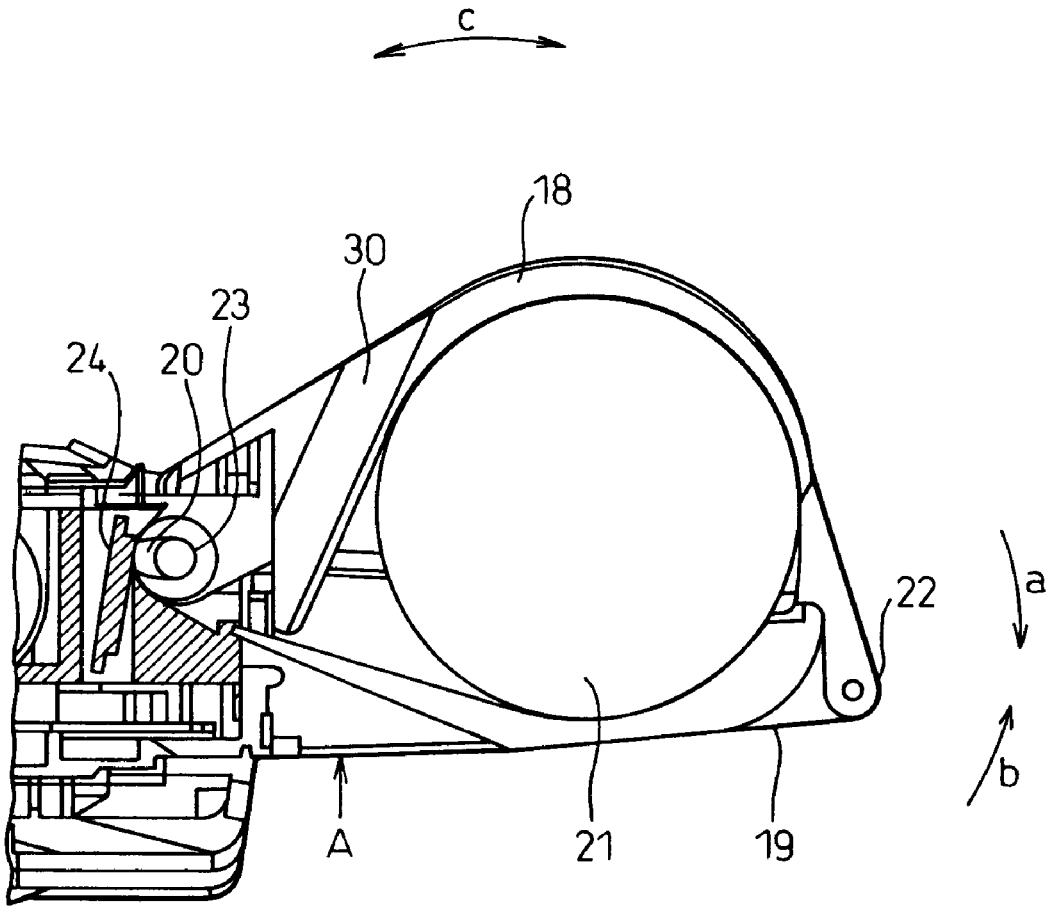
FIG. 4 is a sectional view of a conventional thermal printer.

In this regard, contrary to the conventional thermal printer shown in FIG. 4 in which the printer head 24 is inclined rightward in the side view and in contact with the platen 20, the printer head 24 of the embodiment shown in FIG. 3 is mounted generally perpendicular to a straight line connecting a contact point between the printer head 24 and the platen 20 to the hinge 22. Accordingly, when the printer cover 30 is detached from the body 11 of the portable type terminal equipment 10, and even when not only a force in the direction shown by the arrow b but also a force in the direction shown by the arrow a in FIG. 3 are applied to the printer cover 30, there is no inconvenience in that the platen 20 remains while being in contact with the printer head 24, and the printer cover 30 can be detached while normally carrying the platen 20 in the upper cover 18, as the pressure applied to the platen 20 by the printer head 24 is lower than that in the conventional thermal printer. Thus, no failure occurs in the platen 20 or the peripheral parts. Also, as the pressure applied by the printer head 24 to the platen 20 is reduced, there is an additional effect in that the user can easily open the upper cover 18 with a smaller force.

In this regard, while the description has been made in this embodiment on a thermal printer to be connected to a portable type terminal equipment mainly used in the distribution field, the present invention should not be limited thereto, but, of course, it is applicable to a thermal printer to be connected to a POS terminal equipment.

According to the present invention, it is possible to realize a thermal printer free from the coming-off of a platen even if the printer cover is irregularly operated. Also, a force necessary for the user to open the upper cover upward becomes smaller, resulting in an easy the opening operation.

The invention claimed is:

1. A thermal printer connectable to a portable type terminal equipment, said thermal printer comprising:

a printer head for carrying out printing operation onto a printing medium;

a printer cover having members coupled together by a hinge to be openable and closable; and a platen provided in the printer cover in contact with the printer head when the printer cover is closed;

wherein a straight line connecting a shaft of the platen to a shaft of the hinge is parallel to a bottom surface of the portable type terminal equipment and the printer head is perpendicular to the straight line connecting the platen shaft to the pivot axis when the thermal printer is connected to the portable type terminal equipment.

2. A thermal printer according to claim 1, wherein said members of the printer cover comprise an upper cover and a lower cover, and the upper cover is rotatable relative to the lower cover on about the pivot axis to be openable and closable.

* * * * *